United States Patent [19]

Somerville

[11] 4,425,694

[45] Jan. 17, 1984

[54] SELF-ADJUSTING ROLLER AND METHOD OF USE

[75] Inventor: Richard C. Somerville, Duxbury, Mass.

[73] Assignee: Globe Rubber Works, Inc., Rockland, Mass.

[21] Appl. No.: 304,637

[22] Filed: Sep. 22, 1981

[51] Int. Cl.[3] ..... B21B 27/02

[52] U.S. Cl. ..... 29/110; 29/132

[58] Field of Search ..... 29/110 R, 121.3, 132; 271/272–279; 226/186, 187, 191, 192

[56] References Cited

U.S. PATENT DOCUMENTS

| | | | |
|---|---|---|---|
| 437,208 | 9/1890 | Kinney | 226/186 |
| 1,749,393 | 3/1930 | Pfumlin | 29/132 X |
| 2,715,024 | 8/1955 | Nydegger et al. | 226/191 |
| 3,486,543 | 12/1969 | Nishimura | 29/132 X |

FOREIGN PATENT DOCUMENTS

| | | | |
|---|---|---|---|
| 17779 | of 1894 | United Kingdom | 29/121 A |

*Primary Examiner*—Eugene F. Desmond

*Attorney, Agent, or Firm*—Richard P. Crowley

[57] ABSTRACT

A self-adjusting resilient roller, particularly for use with a feed roller, to provide for a self-adjusting system whereby the self-adjusting roller will conform to various thicknesses of sheet material between the self-adjusting roller and the feed roller without adjusting the position of the rollers, the self-adjusting roller formed of resilient material having a central axial pasageway for a shaft, and a plurality of smaller generally circular openings surrounding the central passageway and characterized further by a generally triangular opening toward the outer periphery of the self-adjusting roller and between each smaller circular opening, so as to provide a generally uniform wall thickness of resilient material surrounding each of the circular openings in the self-adjusting roller, whereby uniform resiliency under compression is imparted to the roller.

18 Claims, 3 Drawing Figures

SELF-ADJUSTING ROLLER AND METHOD OF USE

BACKGROUND OF THE INVENTION

Typically, feed systems for feeding sheet-like materials, such as paperboard, or paper or plastic sheets and the like, comprise at least one feed roller or one or more idler rollers in combination therewith. For example, the feed roller may comprise a driven hard roller on the bottom, such as a steel roller having a knurled surface, or a hard elastomeric surface roller with an idler roller positioned above the feed roller. Where the feed system is to feed sheet materials, for example, of various thickness, adjustments can be made to the feed or idler roller to provide for different thicknesses. Often such feed material requires an energy source to adjust the tension or surface pressure on the material to be fed when the material changes in thickness or dimension. Such adjustment of surface pressure or tension is accomplished by mechanical, electrical or hydraulic systems, or by merely removing and respacing the distance between the feed and idler rollers to obtain the desired surface pressure for feeding purposes. Such systems require constant adjustment as material of different dimensions are fed through the system or require complex systems to adjust the tension or surface pressure.

A self-adjusting roller, either as a feed roller or an idler roller, would be desirable where such a roller would conform to various thicknesses of materials being used in the system; that is, being rolled over or under without any outside energy sources for adjusting or moving the roller.

Resilient-type rollers have been developed for various purposes. For example, U.S. Pat. No. 2,572,276 discloses a resilient roller prepared from an extrudable material, the roller having a corrugated surface and having a central opening through the shaft and surrounded by a plurality of pear-shaped openings. Resilient rollers have also been employed in handling fragile-type materials, such as eggs, as shown in U.S. Pat. No. 3,272,309, wherein a transport member comprises a core portion and has a plurality of generally circular openings about the outer portion of the roller. The roller is formed of resilient material and has circular openings of such dimensions that the eggs to be transported may be moved under the roller without damage.

SUMMARY OF THE INVENTION

My invention relates to a self-adjusting resilient roller and to a feed system containing the roller and to the method of use of the roller. In particular, my invention concerns a self-adjusting resilient roller which will conform to various thicknesses of material being rolled over or under the roller without any outside energy sources for adjustment of the roller.

My invention comprises a resilient roller which may be either used alone or in conjunction with other rollers, either as an idler or a feed roller, and to a roller system. My roller will conform to various thicknesses of material being rolled under or over a roller. The design of my self-adjusting roller, coupled with the mechanical advantages of the material of the roller, provides for a roller which is self-adjusting and which deflects more readily than a solid material or a foam material when under compression, but yet which retains its generally cylindrical shape except where compression occurs.

The design of my roller permits deflection in use of up to 40% deflection of the roller circumference.

The design of my self-adjusting roller, made of resilient material, provides a substantially uniform resilience under compression by providing substantially uniform wall thickness between various peripheral openings toward the outer peripheral surface of the roller. The self-adjusting roller of the invention comprises a generally cylindrical roller of a resilient material, the roller having a peripheral outer surface, which surface may be smooth, corrugated, knurled or otherwise as desired. The roller is characterized by a series of passageways and openings which comprise a central axial passageway, generally the largest opening extending through the material, and which passageway is adapted to receive a shaft, which is a drive shaft or idler shaft, about which the roller may be driven or revolve.

The roller design also includes a plurality of generally uniform, spaced-apart, generally circular openings extending axially through the resilient material of the roller. The circular openings are positioned generally uniformly about the central axial passageway and in close approximation with the outer peripheral wall surface of the roller, a portion of the wall about the circular opening constituting an arcuate portion of the outer wall surface forming the peripheral outer surface of the roller of desired thickness. The circular openings may vary in number and dimensions and generally are smaller in dimension than the axial passageway and may comprise from, e.g., about 6 in a 3″ roller to 12 or 18 or more depending on the diameter of the roller employed. For example, the ratio of the diameter of the axial passageway to the diameter of the circular openings may range, for example, from about 3 to 1, and more particularly, 2 to 1.25.

My roller design also includes as an essential feature a plurality of generally uniform openings which are smaller than the circular openings and which extend axially through the resilient material of the roller. These small peripheral openings are preferably triangular-like in shape, and positioned toward the outer peripheral surface of the roller, with each opening spaced between the adjacent circular openings. These peripheral openings are shaped and dimensioned and positioned together with the axial passageway, so as to provide a generally uniform wall thickness of resilient material about and surrounding the circular openings to provide a roller which uniformly compresses, or is uniformly resilient under pressure, so as the entire roller will not be deformed. Where the wall thickness between the circular openings is substantially uniform, then the roller may be subject to deformation under compression to much greater extent than a roller of a foam material, or a resilient material, that does not have the peripheral openings and substantially uniform wall thickness.

The peripheral openings may vary in size and shape; however, in one preferred embodiment, the triangular opening is formed with the sides of the triangular opening arcuate in nature, with one side following the general radius of the outer periphery of the roller and the other sides following the general exterior radius of the circular openings on either side. The axial passageway, the circular openings and the peripheral openings should be such that a substantial portion of the roller represents void space, such as for example, over about 70%, more typically over 80%. The circular openings are so placed so that the wall thickness surrounding the circular openings; that is, the ribs of material forming the interior of the roller in a cross-section view, are generally uniform in wall thickness, except where adjoining ribs meet. In one embodiment, the arcuate portion of the circular opening toward the exterior surface of the roller is slightly thicker, in order to provide a roller of long life by increasing the peripheral surface thickness of the material.

A variety of natural or synthetic materials may be employed as resilient materials of which the roller is formed, but typically the roller is from a molded synthetic material, such as elastomeric material like an elastomeric urethane polymer. The resilient material may be solid or foam, or a combination of the two, but more particularly is a polymeric elastomeric material typically having a Shore hardness range of 25A minimum, to a maximum of 95A, more particularly, for example, about 40A to about 65A. The exact nature of the hardness depends on the diameter of the roller and how much pressure is to be exerted against the roller in the particular system to which the roller is employed; that is, depending on the variations of the thickness of the material handled by the self-adjusting roller. Typical suitable elastomeric materials include, but are not limited to, neoprene rubber, gum rubber, butyl rubber, butadiene-styrene rubbers, vinyl-chloride resins and other material.

My self-adjusting roller design may be employed alone or in combination with a feed or idler roller, or other system, for feeding sheet material, such as paper sheets, plastic sheets, paper board or the like, where the material may vary in thickness. Typically in a roller system, the feed roller may comprise an idler roller placed in a spaced relationship to a driven hard roller which forces sheet materials between the spaced rollers, such as by the use of a knurled surface or by an elastomeric friction-type surface, in the feed or driven roller. The roller may comprise a driven feed roller or an idler roller whose function is to act as a hold-down roller. The design of my self-adjusting roller permits the roller, on compression, to deflect internally on compression without substantial deflection of the rubber surface not under pressure. It has been found that where the resilient roller does not have the peripheral openings, then the resilient roller has such a variation of wall thickness that it does not permit substantial deflection within itself for uniform compression. Thus, my feed roller requires, for its proper operation, a substantially uniform wall thickness, with the use of the peripheral openings generally uniformly spaced about the spaced circular openings.

DESCRIPTION OF THE EMBODIMENTS

Figure 1:
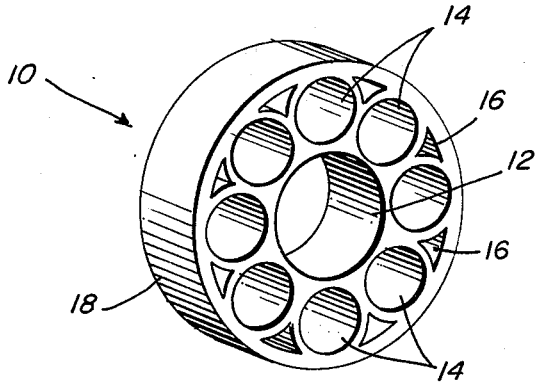
FIG. 1 is a perspective view of the self-adjusting roller of the invention.

FIG. 1 shows a self-adjusting roller 10 of the invention molded from a solid elastomeric polyurethane resin, which roller is characterized by an axial passageway 12 adapted to receive a shaft, either an idler shaft or a driven shaft, and a plurality of smaller circular openings 14 and a plurality of generally triangular-shaped openings 16. The triangular-shaped openings have arcuate sides, with the outer arcuate side following the radius of the smooth outer peripheral surface 18 of the roller. As illustrated, the arcuate sides of triangular openings 16 follow the radius of the adjacent circular openings. The self-adjusting roller illustrated has a diameter of approximately $3\frac{1}{2}$ inches and axial passageway of $1\frac{1}{4}$ inches, circular openings of $\frac{3}{4}$ inches and the material has a Shore hardness of about 60A.

Figure 2:
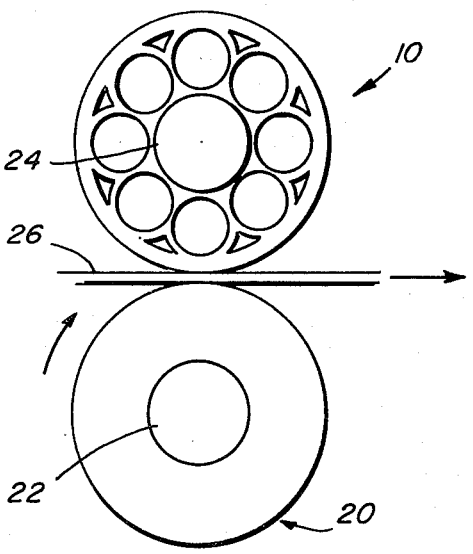
FIG. 2 is a generally sectional view of a feed system employing the self-adjusting roller of the invention.

FIG. 2 is a sectional view of a feed system, with the self-adjusting roller 10 as an idler roller on an idler shaft 24 and spaced above a rigid feed roller 20, with a driving shaft 22 with a sheet material 26 of one thickness shown driven through the feed system, with the self-adjusting roller 10 in a substantially noncompressed position, exerting sufficient surface pressure and tension for the feeding of the sheet material 26.

Figure 3:
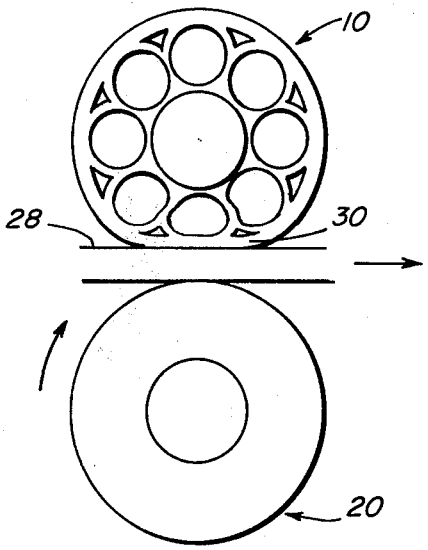
FIG. 3 is a generally sectional view of a feed system employing the self-adjusting roller of the invention, wherein the self-adjusting roller is internally compressed by a sheet of greater thickness.

FIG. 3 shows the feed system of FIG. 2, with the material 28 of thicker dimensions, and illustrates the inward compression area 30 of the roller 10, as the roller is pressed inwardly in area 30 by the thicker material 28, without the need to readjust the position or spacing of the roller 10 or feed roller 20.

What is claimed is:

1. A self-adjusting resilient roller, which roller comprises a cylindrical roller formed of a resilient material and having a peripheral outer surface, the roller characterized by:

(a) a central axial passageway, which passageway is adapted to receive a shaft therein about which the roller may revolve;

(b) a plurality of generally smaller-sized spaced-apart and generally circular openings extending axially through the roller, and positioned generally uniformly about the central axial passageway; and (c) a plurality of generally uniformly shaped peripheral openings, the openings smaller than the circular openings and extending axially through the roller, each opening positioned toward the outer peripheral surface of the roller and between the adjacent circular openings, to provide, with the axial passageway, a generally uniform wall thickness of resilient material about the circular openings, thereby providing a self-adjusting resilient roller of substantially uniform resiliency, so that the roller will conform to various thicknesses of sheet material in contact with the roller, without substantial deformation of that portion of the roller out of contact with the sheet material.

2. The roller of claim 1 wherein the resilient material has a Shore hardness of from about 25A to 95A.

3. The roller of claim 1 wherein the peripheral openings between the adjacent circular openings are generally triangular in form.

4. The roller of claim 1 wherein the openings adjacent to circular openings are generally triangular in form, with the sides of the triangular openings arcuate with one side to follow the circumference of the peripheral outer surface of the roller and the other sides to follow respectively the outside radius of the adjacent circular openings.

5. The roller of claim 1 wherein the ratio of the diameter of the axial passageway to the diameter of the circular openings ranges from about 3 to 1.

6. The roller of claim 1 wherein the resilient material comprises a solid elastomeric urethane material having a Shore hardness of from about 40A to 65A.

7. The roller of claim 1 wherein the outer peripheral surface comprises a smooth elastomeric peripheral outer surface.

8. The roller of claim 1 wherein the wall thickness of the circular opening adjacent the peripheral outer surface of the circular roller, is thicker than the wall surface about the remaining portion of the circular opening, thereby providing a roller having a continuous peripheral wall surface generally slightly thicker than the wall thickness of the circular openings.

9. The roller of claim 1 wherein the axial passageway, the circular openings and the shaped peripheral openings represent over about 70% void space of the roller.

10. The resilient roller of claim 1 having a shaft extending through the axial passageway and the roller in combination, and in a spaced relationship with another roller, whereby material fed between the resilient roller and the other roller may vary in thickness.

11. The roller system of claim 10 wherein the other roller comprises a rigid steel roller having a knurled surface.

12. The roller system of claim 10 wherein the resilient roller comprises an idler roller and the other roller comprises a driven feed roller.

13. The roller system of claim 10 wherein the other roller comprises a rigid rubber having a hard elastomeric surface.

14. A self-adjusting resilient roller, which roller comprises a cylindrical roller formed of a resilient material having a Shore hardness from about 25A to 95A and having a peripheral outer surface, the roller characterized by:

(a) a central axial passageway, which passageway is adapted to receive a shaft therein about which the roller may revolve;

(b) a plurality of generally smaller-sized spaced-apart and generally circular openings extending axially through the roller, and positioned generally uniformly about the central axial passageway; and (c) a plurality of generally uniformly shaped peripheral openings between the adjacent circular openings and generally triangular in form, the openings smaller than the circular openings and extending axially through the roller, each opening positioned toward the outer peripheral surface of the roller and between the adjacent circular openings, to provide, with the axial passageway, a generally uniform wall thickness of resilient material about the circular openings, thereby providing a self-adjusting resilient roller of substantially uniform resiliency, so that the roller will conform to various thicknesses of sheet material in contact with the roller, without substantial deformation of that portion of the roller out of contact with the sheet material.

15. The roller of claim 14 wherein the openings adjacent to circular openings are generally triangular in form, with the sides of the triangular openings arcuate with one side to follow the circumference of the peripheral outer surface of the roller and the other sides to follow respectively the outside radius of the adjacent circular openings.

16. The resilient roller of claim 14 wherein the resilient roller is in combination with another rigid roller in a spaced-apart relationship in a feed roller system, and wherein the resilient roller is an idler roller and the other roller is a driven feed roller.

17. The roller of claim 14 wherein the resilient material comprises an elastomeric urethane material.

18. The roller of claim 14 wherein the ratio of the diameter of the axial passageway to the diameter of the circular openings ranges from about 2 to 1.25.

* * * * *